US010293219B2

(12) United States Patent
Hayashi

(10) Patent No.: US 10,293,219 B2
(45) Date of Patent: May 21, 2019

(54) GOLF CLUB HEAD

(71) Applicant: DUNLOP SPORTS CO. LTD., Kobe-shi, Hyogo (JP)

(72) Inventor: Kazuhiro Hayashi, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/855,190

(22) Filed: Dec. 27, 2017

(65) Prior Publication Data

US 2018/0178090 A1 Jun. 28, 2018

(30) Foreign Application Priority Data

Dec. 28, 2016 (JP) ..... 2016-256939

(51) Int. Cl.
*A63B 53/04* (2015.01)
*B21K 17/00* (2006.01)

(52) U.S. Cl.
CPC .. *A63B 53/0466* (2013.01); *A63B 2053/0433* (2013.01); *A63B 2053/0441* (2013.01); *A63B 2053/0458* (2013.01); *A63B 2209/10* (2013.01); *B21K 17/00* (2013.01)

(58) Field of Classification Search
USPC ..... 473/324–350
See application file for complete search history.

(56) References Cited

U.S. PATENT DOCUMENTS 2,842,369 A * 7/1958 East ..... A63B 69/3632 473/242
4,345,763 A * 8/1982 Swanson ..... A63B 53/00 473/242
5,158,297 A * 10/1992 Johnson ..... A63B 69/3632 473/201
6,062,986 A * 5/2000 Kaise ..... A63B 53/0487 473/242
6,623,374 B1 * 9/2003 Helmstetter ..... A63B 53/04 473/291
7,500,926 B2 * 3/2009 Rae ..... A63B 53/0466 473/345
7,758,440 B2 * 7/2010 Llewellyn ..... A63B 53/0466 473/244

(Continued)

FOREIGN PATENT DOCUMENTS

GB 2149670 A * 6/1985 ..... A63B 69/3632
JP 2008154999 A * 7/2008 ..... A63B 53/0466

(Continued)

*Primary Examiner* — Alvin A Hunter
(74) *Attorney, Agent, or Firm* — Birch, Stewart, Kolasch & Birch, LLP

(57) ABSTRACT

A golf club head according to the present invention is provided with a face portion, a crown portion and a sole portion, the crown portion including a first area extending in a toe-heel direction along at least part of the face portion and a second area arranged further to a back side than the first area, a sloped surface that extends in the toe-heel direction and slopes downward approaching the back side being formed between the first area and the second area, and a transfer sheet that is formed in a shape corresponding to the sloped surface and is a different color from the first area and the second area being stuck to the sloped surface.

16 Claims, 7 Drawing Sheets

(56) References Cited

U.S. PATENT DOCUMENTS 7,762,905 B2 * 7/2010 Park ..... A63B 53/047 473/290
7,789,773 B2 * 9/2010 Rae ..... A63B 53/0466 473/345
7,789,774 B2 * 9/2010 Rae ..... A63B 53/0466 473/345
8,226,501 B2 * 7/2012 Stites ..... A63B 53/0466 473/349
8,348,780 B2 * 1/2013 Stites ..... A63B 53/0466 473/231
8,517,862 B2 * 8/2013 Stites ..... A63B 53/0466 473/345
8,556,742 B2 * 10/2013 John ..... A63B 53/0466 473/219
8,986,131 B2 * 3/2015 Stites ..... A63B 53/0466 473/327
8,992,338 B2 * 3/2015 Willett ..... A63B 53/04 473/327
9,011,265 B2 * 4/2015 Stites ..... A63B 53/0466 473/327
9,962,582 B2 * 5/2018 Antku ..... A63B 53/0466
10,022,598 B2 * 7/2018 Willett ..... A63B 53/04
2013/0324293 A1 * 12/2013 Stites ..... A63B 53/0466 473/327

FOREIGN PATENT DOCUMENTS

JP 2012148138 A * 8/2012 ..... A63B 53/0466
JP 2015-29628 A 2/2015
WO WO 2007115202 A2 * 10/2007 ..... A63B 53/0466

* cited by examiner

E1 Cross-section

GOLF CLUB HEAD

TECHNICAL FIELD

The present invention relates to a golf club head and a manufacturing method for the same.

BACKGROUND ART

In recent years, golf club heads have been proposed in which a raised portion is provided on the crown portion and a sloped surface is formed as the step between the raised portion and the portion rearward thereof. For example, with a golf club head described in Patent Literature 1, a polarization coating material is coated on the step (sloped surface) of such a crown portion. By sighting this step, it becomes easier for the golfer to determine the directionality of the shot at address.

JP 2015-29628A is an example of related art.

With the golf club head described in Patent Literature 1, the visibility of the step can also be raised by applying the polarization coating material. However, in the case where the polarization coating material is applied, the visibility of the step is dependent on the orientation of sunlight, thus making it difficult to reliably improve visibility. Furthermore, although it is also conceivable to only perform coating on the step, precisely coating only the step is not easy, and could also possibly lead to a drop in productivity and a deterioration in yield. The present invention was made in order to solve the above problems, and an object thereof is to provide a golf club head and a manufacturing method for the same that enable the visibility of a step (sloped surface) provided on the crown portion to be improved, in order to determine the directionality of the shot at address.

SUMMARY OF THE INVENTION

A golf club head according to the present invention is provided with a face portion, a crown portion and a sole portion, the crown portion including a first area extending in a toe-heel direction along at least part of the face portion and a second area arranged further to a back side than the first area, a sloped surface that extends in the toe-heel direction and slopes downward approaching the back side being formed between the first area and the second area, and a transfer sheet that is formed in a shape corresponding to the sloped surface and is a different color from the first area and the second area being stuck to the sloped surface.

In the above golf club head, the first area can be arranged in a higher position than the second area.

In the above golf club heads, a configuration can be adopted in which aback end edge of the first area and a front end edge of the second area are connected by the sloped surface.

In the above golf club heads, a groove extending in the toe-heel direction can be formed between the first area and the second area, and one of inner wall surfaces of the groove can be constituted by the sloped surface.

In the above golf club heads, a width, in plan view, of the sloped surface in a face-back direction can be set to 3 to 9 mm.

In the above golf club heads, a toe-side width, in plan view, of the sloped surface in the face-back direction corresponding to a first point that is 30 mm in the toe direction from a center of the face portion in the toe-heel direction can be made larger than a heel-side width, in plan view, of the sloped surface in the face-back direction corresponding to a second point that is 30 mm in the heel direction from the center, and a difference between the toe-side width and the heel-side width can be set to 3 to 7 mm.

A manufacturing method of a golf club head according to the present invention is provided with a step of preparing a golf club head base material that includes a face portion, a crown portion and a sole portion, the crown portion including a first area extending in a toe-heel direction along at least part of the face portion and a second area arranged further to a back side than the first area, and a sloped surface that extends in the toe-heel direction and slopes downward approaching the back side being formed between the first area and the second area, and a step of sticking a transfer sheet that has a shape corresponding to the sloped surface and is a different color from the first area and the second area to the sloped surface.

In the manufacturing method for a golf club head, a step of applying a clear layer that covers at least the transfer sheet.

According to the present invention, the visibility of a sloped surface provided on the crown portion can be improved, in order to determine the directionality of the shot at address.

EMBODIMENTS OF THE INVENTION

Figure 1:
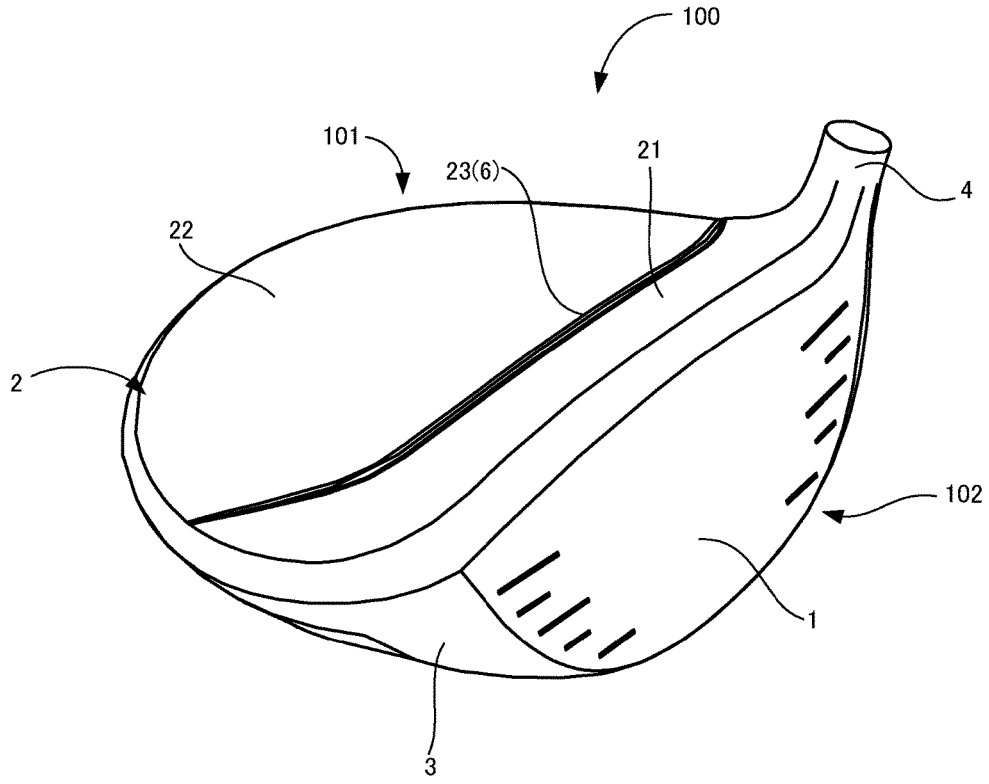
FIG. 1 is a perspective view of a golf club head according to an embodiment.
Figure 2:
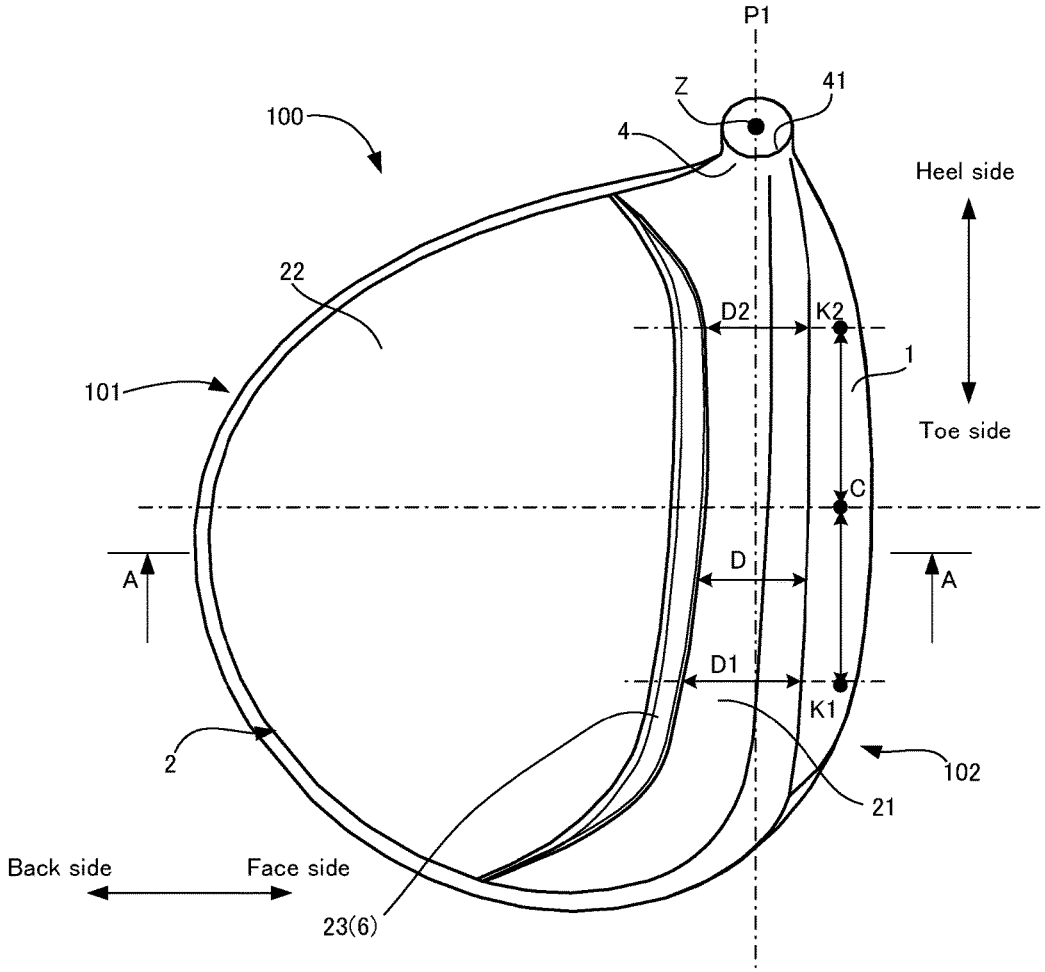
FIG. 2 is a plan view in a reference state of the head of FIG. 1.
Figure 3:
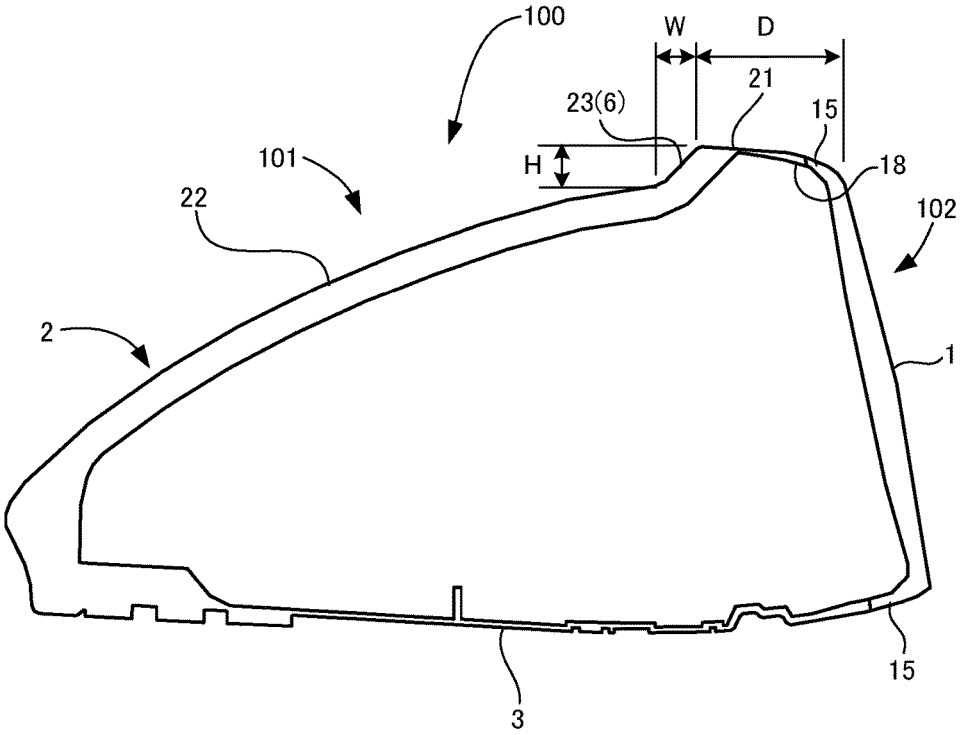
FIG. 3 is cross-sectional view along an A-A line of FIG. 2.

Hereinafter, an embodiment of a golf club head according to the present invention will be described, with reference to the drawings. FIG. 1 is a perspective view of this golf club head, FIG. 2 is a plan view in a reference state of the head, and FIG. 3 is a cross-sectional view along an A-A line of FIG. 2. Note that the reference state of the golf club head will be discussed later.

1. Overview of Golf Club Head

As shown in FIGS. 1 to 3, this golf club head (hereinafter, may be simply referred to as "head") 100 is a wood-type golf club head that is a hollow structure having an interior space, and whose wall surfaces are formed by a face portion 1, a crown portion 2, a sole portion 3 and a hosel portion 4. Specifically, the present invention can be applied to golf club heads such as utilities, fairway woods and drivers.

The face portion 1 has a face surface which is the surface that hits the ball, and the crown portion 2 adjoins the face portion 1 and constitutes the upper surface of the head 100.

The sole portion 3 mainly constitutes the bottom surface of the head 100, and constitutes the outer perimeter surface of the head 100 other than the face portion 1 and the crown portion 2. That is, besides the bottom surface of the head 100, the region extending from the toe side of the face portion 1 around the back side of the head to the heel side of the face portion 1 is also part of the sole portion 3. Furthermore, the hosel portion 4 is a region that is provided adjoining the heel side of the crown portion 2, and has an insertion hole 41 into which the shaft (illustration omitted) of the golf club is inserted. A central axis line Z of this insertion hole 41 coincides with the axis line of the shaft.

Here, the reference state when setting the golf club head 100 on the ground will be described. First, as shown in FIGS. 2 and 3, a state in which the central axis line Z is contained in a plane P1 that is perpendicular to the ground and the head is placed on the ground at a predetermined lie angle and real loft angle is prescribed as the reference state. The plane P1 is called a reference perpendicular plane. Also, as shown in FIG. 2, the direction of the line of intersection between the reference perpendicular plane P1 and the ground is called the toe-heel direction, and the direction perpendicular to this toe-heel direction and parallel to the ground is called the face-back direction.

Figure 4A:
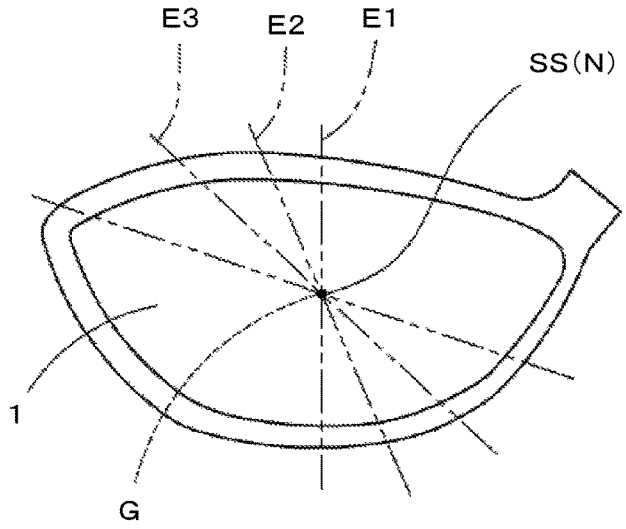
FIG. 4A is a diagram illustrating the boundary of a face portion.
Figure 4B:
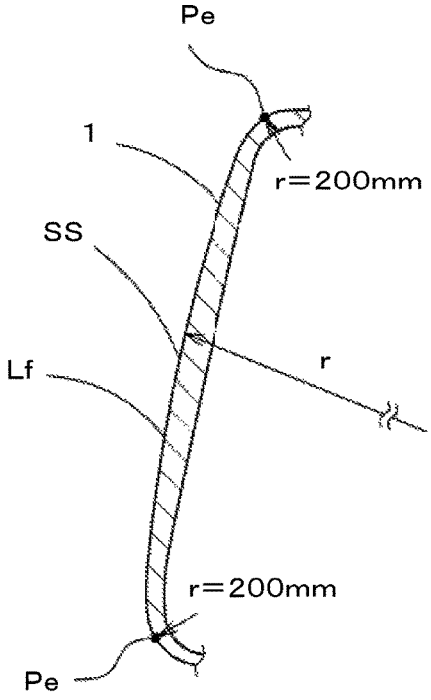
FIG. 4B is a diagram illustrating the boundary of the face portion.

In the present embodiment, the boundary between the face portion 1 and the crown portion 2 and between the face portion 1 and the sole portion 3 can be defined as follows. That is, in the case where a ridgeline is formed therebetween, this ridgeline will be the boundary. On the other hand, in the case where a clear ridgeline is not formed, in each of cross-sections E1, E2, E3 and so forth that contain a straight line N connecting a head center of gravity G and a sweet spot SS, as shown in FIG. 4A, a position Pe at which a radius of curvature r of a contour Lf of the face outer surface first reaches 200 mm from the sweet spot side toward the face outer side will be the periphery of the face portion 1, as shown in FIG. 4B, and this periphery is defined as the boundary with the crown portion 2 or the sole portion 3. Note that the sweet spot SS is the point of intersection between the normal (straight line N) of the face surface that passes through the head center of gravity G and this face surface.

Also, in the present embodiment, the boundary between the crown portion 2 and the sole portion 3 can be defined as follows. That is, in the case where a ridgeline is formed between the crown portion 2 and the sole portion 3, this ridgeline will be the boundary. On the other hand, in the case where a clear ridgeline is not formed therebetween, the contour seen when the head is set in the reference state and viewed from directly above the center of gravity of the head 100 will be the boundary.

Also, the head 100 can, for example, be formed with a titanium alloy (Ti-6Al-4V) whose specific gravity is approximately about 4.4 to 4.5. Other than a titanium alloy, the head 100 can also be formed using one type or two or more types of material including stainless steel, maraging steel, an aluminum alloy, a magnesium alloy or an amorphous alloy, for example.

Also, the volume of this golf club head 100 is, for example, from 90 $cm^3$ to 460 $cm^3$ inclusive.

2. Assembly Structure of Golf Club Head

The golf club head 100 according to the present embodiment is, as shown in FIG. 3, constituted by assembling a head main body 101 having the crown portion 2 and the sole portion 3, and a cup-shaped face member 102 having the face portion 1 and a peripheral portion 15 that extends from a periphery of the face portion 1. This head main body 101 has an opening 18 surrounded by the crown portion 2 and the sole portion 3, and the face member 102 is attached so as to close this opening 18. That is, the end surface of the peripheral portion 15 of the face member 102 is butted against the end surface of the opening 18 of the head main body 101, and these end surfaces are joined by welding (so-called cup face structure). The face member 102 is then integrated with the head main body 101 by being attached to the edge portion of the opening 18 of the head main body 101, and the peripheral portion 15 of the face member 102 thereby functions as part of the crown portion 2 and the sole portion 3 of the head 100.

Accordingly, the surfaces that are integrally formed as a result of the peripheral portion 15 of the face member 102 being attached to the head main body 101 constitute the crown portion 2 and the sole portion 3 of the head 100. Thus, strictly speaking, the crown portion 2 and the sole portion 3 of the head main body 101 are part of the crown portion 2 and the sole portion 3 of the head 100, although, in this specification, these portions of the head main body 101 may also be referred to simply as the crown portion 2 and the sole portion 3, without making this distinction.

3. Structure of Crown Portion

Figure 5:
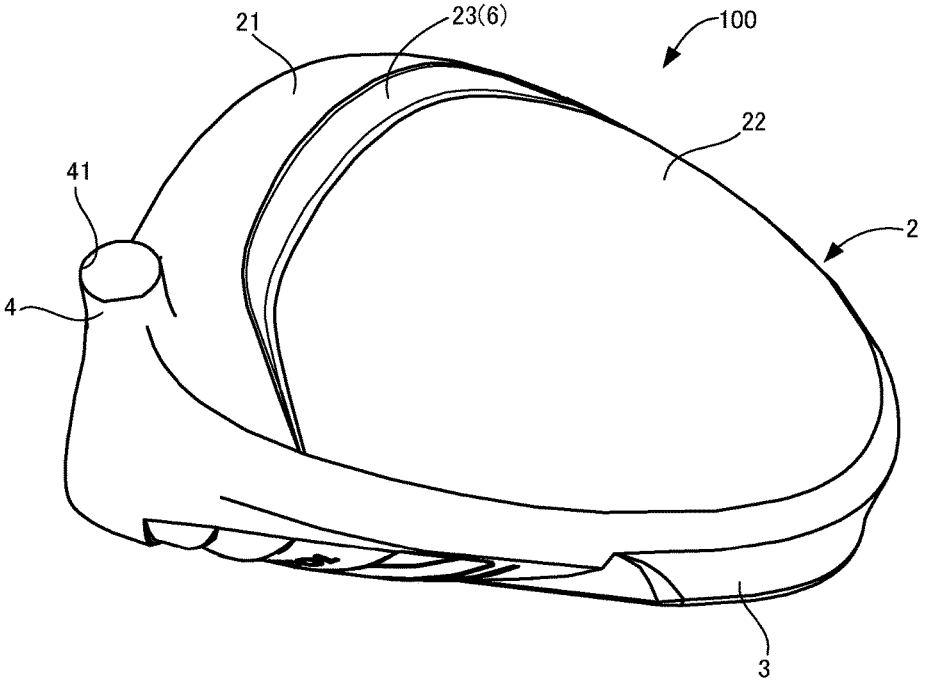
FIG. 5 is a perspective view of the golf club head of FIG. 1 as seen from the heel side.

Next, the crown portion 2 will be described, with reference also to FIG. 5. FIG. 5 is a perspective view of the golf club head according to the present embodiment as seen from the heel side. As shown in FIGS. 1 to 3 and FIG. 5, the crown portion 2 is constituted by a raised portion (first area) 21 that is arranged on the face portion side, and a base portion (second area) 22 that is arranged further to the back side than the raised portion 21. The raised portion 21 is mainly a band-like area extending in the toe-heel direction along the face portion 1, with the end portions on the toe side and the heel side extending slightly to the back side along the periphery of the crown portion 2, and is formed as a whole in a U-shape in plan view. On the other hand, the base portion 22 is an area that occupies most of the crown portion 2 at a lower position than the raised portion 21, and the periphery thereof contacts the sole portion 3. A sloped surface 23 that constitutes a step is formed at the boundary between the raised portion 21 and the base portion 22. The height of the face portion 1 in the up-down direction is thereby increased by the amount of the step between the raised portion 21 and the base portion 22.

This sloped surface 23 is constituted so as to extend upward, approaching the face portion 1 side. The sloped surface 23 can thereby be sighted from above, when the golf club head 100 is set in the reference state. That is, the sloped surface 23 is visible to a golfer who has taken his or her address position. The sloped surface 23 is formed along the raised portion 21, and is thus formed in a U-shape in plan view, similarly to the raised portion 21.

As shown in FIG. 2, a width D of the raised portion 21 in the face-back direction is, in plan view, preferably set to 5 to 20 mm, and more preferably set to 7 to 15 mm, for example. Furthermore, the width of the raised portion 21 can be prescribed as follows. That is, as shown in FIG. 2, a width (toe-side width) D1, in plan view, of the raised portion 21 in the face-back direction corresponding to a first point K1 that is 30 mm to the toe side from a center C (face center) of the face portion 1 in the toe-heel direction, and a width (heel-side width) D2, in plan view, of the raised portion 21 in the face-back direction corresponding to a second point K2 that is 30 mm to the heel side from the center C are prescribed. The width D1 is made wider than the width D2, and the difference therebetween can be set to 3 to 7 mm.

Note that the face center can be defined as follows. First, on the face portion 1 (face surface), an arbitrary point Po roughly in a vicinity of the center in the toe-heel direction and the up-down direction is determined. A line x extending in the toe-heel direction through this point Po is drawn, and a midpoint Px of this line x is determined. Next, on the face portion 1, a line y extending in the up-down direction through the point Px is drawn, and a midpoint Py of this line is determined. A process of redrawing, as the line x, a line extending in the toe-heel direction through the point Py thus determined and thereafter redetermining the point Py in the manner described above is then repeated. The new point Py when the distance between the previous point Py and the new point Py becomes less than or equal to 1 mm during the repetition of this process is defined as the face center. Note that, more specifically, the line x passing through the point Po is the line of intersection between the face surface (surface of the face portion 1) and a plane that contains the normal of the face surface passing through this point Po and is parallel to the toe-heel direction. Also, more specifically, the line y passing through the point Px is the line of intersection between the face surface and a plane that contains the normal of the face surface passing through this point Px and is parallel to the up-down direction. Also, more specifically, the line x passing through the point Py is the line of intersection between the face surface and a plane that contains the normal of the face surface passing through this point Py and is parallel to the toe-heel direction. Note that the lengths of the line x and the line y are measured along the face surface.

Effects such as the following can be obtained by making the width D1 wider than the width D2. That is, since the toe side of the golf club head 100 is, from the perspective of the golfer, far away when the golfer has taken his or her address position, the width on the toe side of the raised portion 21 looks small compared to the width on the heel side. Thus, there is a risk that the golfer may feel a sense of incongruity. In view of this, when the width D1 on the toe side is widened, as described above, the golfer does not perceive that there is a difference in the width of the raised portion 21 between the toe side and heel side. Therefore, the sense of incongruity can be reduced when the raised portion 21 is viewed at address. Since the toe side looks wide when the difference in width is too large and the toe side looks narrow when the difference in width is too small, the difference is, however, preferably set as described above.

Also, as shown in FIG. 3, a width W, in plan view, of the sloped surface 23 in the face-back direction is preferably set to 3 to 9 mm, and more preferably set to 3 to 7 mm, for example. Furthermore, a height H of the sloped surface 23 is preferably set to 0.5 to 5 mm, more preferably set to 0.5 to 4 mm, and still more preferably set to 0.5 to 2 mm, for example.

4. Transfer Sheet that is Stuck to Slope

In the present embodiment, a transfer sheet 6 is stuck to the sloped surface 23. Hereinafter, this point will be described in detail. Various members can be used for the transfer sheet 6, and, for example, a well-known heat transfer sheet or water transfer sheet such as described below can be used.

4-1. Heat Transfer Sheet

Figure 6:
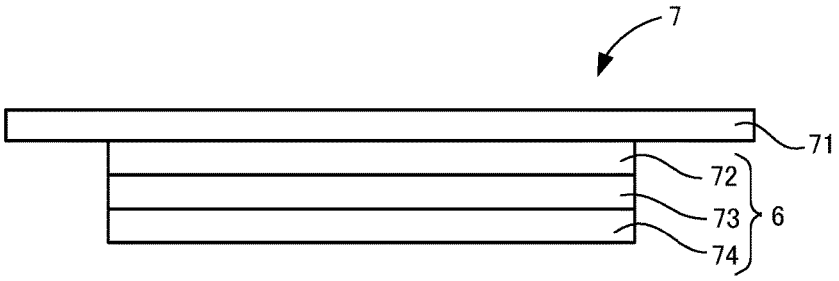
FIG. 6 is a cross-sectional view showing an example of a heat transfer sheet material.

A heat transfer sheet (alternatively called heat transfer foil) can be created as follows. First, as shown in FIG. 6, a transfer sheet material 7 obtained by laminating a transparent protective layer 72, a printed layer 73 and an adhesive layer 74 in this order is prepared on one surface of a transfer base material 71. Of these layers, the transparent protective layer 72, the printed layer 73 and the adhesive layer 74 constitute the transfer sheet 6, and are formed in substantially the same shape as the sloped surface 23.

The transfer base material 71 is not particularly limited as long as the material is formed in a sheet and can withstand the heat and pressure applied at the time of transfer, and can, for example, be formed with a resin material such as polyethylene terephthalate. Also, the transparent protective layer 72 is a layer that is laminated in an exfoliable manner on the transfer base material 71, and has the printed layer 73 laminated thereon. For example, an isocyanate compound or a silane coupling agent can be applied. An exfoliation layer can also be separately provided between the transparent protective layer 72 and the transfer base material 71. The printed layer 73 is a layer obtained by forming a color on the transparent protective layer 72 with a material and a formation method using well-known printing such as gravure printing, silk screen printing and offset printing, or the like. The color of this printed layer 73 will be the color with which the sloped surface 23 is colored. The adhesive layer 74 is a layer for transferring and adhering the transparent protective layer 72 and the printed layer 73 to the sloped surface 23. A well-known thermoplastic resin, hardening resin or the like, for example, can be used as the adhesive layer 74.

The heat transfer sheet material constituted as described above is used as follows. First, the adhesive layer 74 is positioned facing the sloped surface 23 side, and such that the printed layer 73 is arranged in a position corresponding to the sloped surface 23. Heat and pressure are then applied to the transfer base material 71, and the adhesive layer 74 is adhered to the sloped surface 23. Thereafter, when the transfer base material 71 is exfoliated, the transfer sheet 6 in which the adhesive layer 74, the printed layer 73 and the transparent protective layer 72 are laminated in this order is arranged so as to cover the sloped surface 23.

4-2. Water Transfer Sheet

Figure 7:
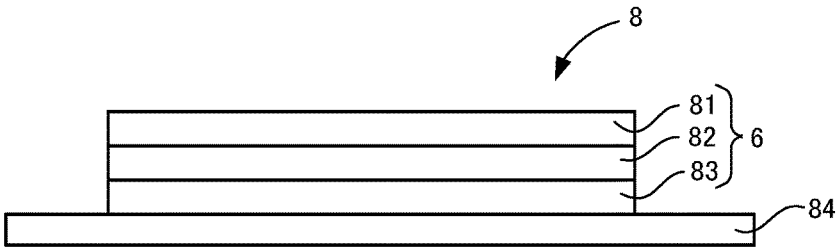
FIG. 7 is a cross-sectional view showing an example of a water transfer sheet material.

A water transfer sheet (alternatively called water transfer foil) can be created as follows. First, as shown in FIG. 7, a water transfer sheet material 8 obtained by laminating a cover coat layer 81, a printed layer 82, an adhesive layer 83 and a base material 84 made of paper in this order is provided. Of these layers, the cover coat layer 81, the printed layer 82 and the adhesive layer 83 constitute the transfer sheet 6, and are formed in substantially the same shape as the sloped surface 23.

The cover coat layer 81 is formed with a resin material such as an acrylic, and the printed layer 82 is a layer obtained by forming a color on this cover coat layer 81 with a material and a formation method using well-known printing such as gravure printing, silk screen printing and offset printing, or the like. The color of this printed layer 82 will be the color with which the sloped surface 23 is colored. Also, the adhesive layer 83 is formed using a water-soluble paste. The base material 84 is formed with a moisture absorbent paper.

The water transfer sheet material constituted as described above is used as follows. First, the water transfer sheet material 8 is soaked in water. Water thereby infiltrates into the base material 84 and some of the water-soluble paste, which is the adhesive layer 83, dissolves. The cover coat layer 81, the printed layer 82 and the adhesive layer 83 constituting the transfer sheet 6 thereby become slidable on the base material 84. The transfer sheet 6 is then moved from the base material 84 onto the crown portion 2, and is positioned on the sloped surface 23. Thereafter, when the transfer sheet 6 is dried, the adhesive layer 83 is fixed to the sloped surface 23.

The color of the transfer sheet 6, that is, the color of the printed layers 73 and 82, such as the described above, is not particularly limited, and needs to at least be a different color from the color of the crown portion 2. Also, characters or graphics, for example, may be drawn on the transfer sheet 6. Note that the above configuration of the transfer sheet 6 is an example, and various types of well-known sheets that are called transfer sheets or transfer foil can be utilized. The material constituting the transfer sheet 6 or the transfer foil is also not particularly limited, and may include a metal layer, besides a resin material and a coating material such as described above.

5. Manufacturing Method for Golf Club Head

Next, an example of a manufacturing method for the above golf club head will be described. First, the head main body 101 and the face member 102 described above are prepared. Such a head main body 101 and face member 102 can be produced with various methods. For example, the head main body 101 can be manufactured by casting such as a well-known lost wax precision casting method. Also, the face member 102 can be manufactured using a forging method, plate pressing, casting or the like, for example. A golf club head base material is completed when these members are joined by welding (TIG (tungsten inactive gas) welding, plasma welding, laser welding, brazing, etc.), for example.

Next, coating is performed on this golf club head base material. Coating can be performed a plurality of times. After the coating has been performed, the transfer sheet 6 is then stuck in the manner described above to the sloped surface 23. Thereafter, a clear layer can also be applied to the entire golf club head base material, if necessary. The clear layer is a coating material that is mainly for achieving a gloss finish, and can be formed with a resin whose base material is a urethane resin, for example. The golf club head is thus completed.

6. Features

According to the above embodiment, the following effects can be obtained.

(1) In the present embodiment, the crown portion 2 is constituted by the base portion 22 that contacts the sole portion 3 and the raised portion 21 that extends in the toe-heel direction along the boundary with the face portion 1 and is raised by forming the sloped surface 23 from the base portion 22, thus enabling the golfer to sight the sloped surface 23 which is the boundary between the raised portion 21 and the base portion 22. Accordingly, the directionality of the shot can be determined at address. In particular, the transfer sheet 6 that differs in color from the crown portion 2 is stuck to the sloped surface 23, thus enabling the sloped surface 23 on which the transfer sheet 6 is stuck to be sighted, irrespective of the orientation of sunlight. Accordingly, the directionality of the shot becomes easier to determine at address. In other words, the orientation of the face surface becomes easier to align with the target direction.

(2) With the crown portion 2, the raised portion 21 is formed higher than the base portion 22 via the sloped surface 23, thus enabling the height of the face portion 1 to be increased by the amount by which the raised portion 21 rises. Thus, the rebound performance of the face portion 1 can be improved. Also, with the crown portion 2, only the raised portion 21 is formed higher, and the base portion 22 occupying most of the crown portion 2 is formed at a lower position than the raised portion 21, thus enabling the center of gravity of the head to be lowered.

(3) The transfer sheet 6 is formed in roughly the same shape as the sloped surface 23, thus enabling the sloped surface 23 to be more easily colored than by coating the sloped surface 23, for example. That is, there is a risk that, when attempting to coat the sloped surface 23, problems such as the coating material flowing outside the sloped surface 23 may occur. In contrast, given that the transfer sheet 6 is the same shape as the sloped surface 23 and is also easily positioned, coloring can be reliably performed in accordance with the shape of the sloped surface 23, using the transfer sheet 6. Cost can thereby be reduced, and the manufacturing process can also be simplified.

7. Variations

Although an embodiment of the present invention has been described above, the present invention is not limited to the above embodiment, and various modifications can be made, without departing from the gist of the invention. Also, the following variations can be combined as appropriate. For example, the following modifications can be made.

7-1

Although, in the above embodiment, the raised portion 21 and the sloped surface 23 are formed in a U-shape in plan view, the present invention is not limited thereto, and these portions need only extend roughly in the toe-heel direction. Accordingly, the raised portion 21 and the sloped surface 23 can, for example, also be formed in a band that extends roughly straight in the toe-heel direction. Also, the sloped surface 23 need only be at least a surface that extends downward approaching the back side, and need not necessarily be a planar surface. For example, the sloped surface can also be formed as a curved surface.

7-2

Figure 8:
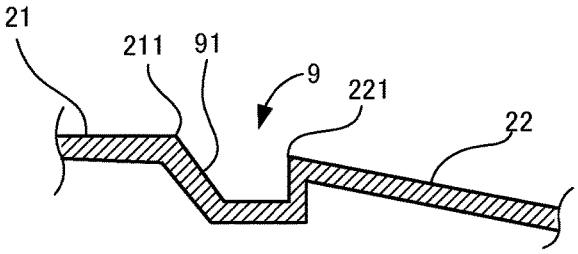
FIG. 8 is a cross-sectional view showing another example of the crown portion.

The configuration of the sloped surface 23 between the raised portion 21 and the base portion 22 is not particularly limited. For example, as shown in FIG. 8, a groove 9 can also be formed between the raised portion 21 and the base portion 22, and the abovementioned transfer sheet 6 can be stuck to a sloped surface 91 that slopes downward, approaching the base portion 22 side from a back end edge 211 of the raised portion 21, out of the inner wall surfaces of this groove 9. Also, the cross-sectional shape of the groove 9 is not particularly limited, and can, for example, also be formed as a curved surface, besides being formed as a rectangle in cross-section.

7-3

Figure 9:
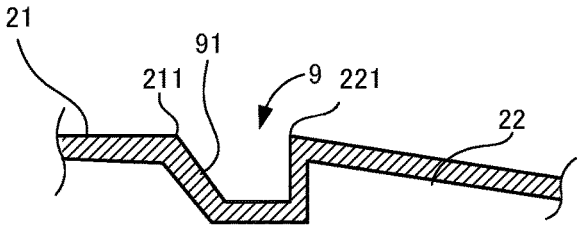
FIG. 9 is a cross-sectional view showing another example of the crown portion.

With regard to the height of the back end edge 211 of the raised portion 21 and a front end edge 221 of the base portion 22, apart from making the raised portion 21 side higher, as shown in FIG. 8, the back end edge 211 of the raised portion 21, and the front end edge 221 of the base portion 22 can, for example, also be made the same height, as shown in FIG. 9.

7-4

Although the head according to the above embodiment is constituted by combining other portions with a head main body that at least has the crown portion 2, the present invention can also be applied to a head in which only the crown portion 2 is formed separately. For example, a head main body having the face portion, the side portion and the sole portion and in which an opening for the crown portion is formed can be prepared, and the head can be constituted by fitting the crown portion into the opening. Also, a cup face structure need not be adopted, and a configuration in which a flat face member is fixed to the head main body can also be adopted.

LIST OF REFERENCE NUMERALS

1 Face portion
2 Crown portion
21 Raised portion (First area)
22 Base portion (Second area)
23 Sloped surface
3 Sole portion
4 Hosel portion

What is claimed is:

1. A golf club head comprising:
a face portion;
a crown portion; and
a sole portion,
wherein the crown portion includes:
a first area extending in a toe-heel direction along at least part of the face portion; and
a second area arranged further to a back side than the first area,
a sloped surface that extends in the toe-heel direction and slopes downward approaching the back side is formed between the first area and the second area, and
a transfer sheet that is formed in a shape corresponding to the sloped surface and is a different color from the first area and the second area is stuck to the sloped surface,
wherein a toe-side width, in plan view, of the first area in the face-back direction corresponding to a first point that is 30 mm in the toe direction from a center of the face portion in the toe-heel direction is larger than a heel-side width, in plan view, of the first area in the face-back direction corresponding to a second point that is 30 mm in the heel direction from the center, and
wherein a difference between the toe-side width and the heel-side width is 3 to 7 mm.

2. The golf club head according to claim 1,
wherein the first area is arranged in a higher position than the second area.

3. The golf club head according to claim 1,
wherein a back end edge of the first area and a front end edge of the second area are connected by the sloped surface.

4. The golf club head according to claim 1,
wherein a groove extending in the toe-heel direction is formed between the first area and the second area, and
one of inner wall surfaces of the groove is constituted by the sloped surface.

5. The golf club head according to claim 1,
wherein a width, in plan view, of the sloped surface in a face-back direction is 3 to 9 mm.

6. The golf club head according to claim 1,
wherein the sloped surface is formed in a U-shape such that the toe side end and the heel side of the sloped surface extend to the back side.

7. The golf club head according to claim 6,
wherein the toe side end and the heel side of the sloped surface is shaped with acute angle.

8. The golf club head according to claim 1,
wherein the transfer sheet comprises an adhesive layer, a printed layer, and a protective layer, and the adhesive layer is adhered to the sloped surface.

9. A golf club head comprising:
a face portion;
a crown portion; and
a sole portion,
wherein the crown portion includes:
a first area extending in a toe-heel direction along at least part of the face portion; and
a second area arranged further to a back side than the first area,
a sloped surface that extends in the toe-heel direction and slopes downward approaching the back side is formed between the first area and the second area, and
a transfer sheet that is formed in a shape corresponding to the sloped surface and is a different color from the first area and the second area is stuck to the sloped surface,
wherein a groove extending in the toe-heel direction is formed between the first area and the second area, and
wherein one of inner wall surfaces of the groove is constituted by the sloped surface.

10. The golf club head according to claim 9,
wherein the first area is arranged in a higher position than the second area.

11. The golf club head according to claim 9,
wherein a back end edge of the first area and a front end edge of the second area are connected by the sloped surface.

12. The golf club head according to claim 9,
wherein a width, in plan view, of the sloped surface in a face-back direction is 3 to 9 mm.

13. The golf club head according to claim 9,
wherein a toe-side width, in plan view, of the first area in the face-back direction corresponding to a first point that is 30 mm in the toe direction from a center of the face portion in the toe-heel direction is larger than a heel-side width, in plan view, of the first area in the face-back direction corresponding to a second point that is 30 mm in the heel direction from the center, and
a difference between the toe-side width and the heel-side width is 3 to 7 mm.

14. The golf club head according to claim 9,
wherein the sloped surface is formed in a U-shape such that the toe side end and the heel side of the sloped surface extend to the back side.

15. The golf club head according to claim 14,
wherein the toe side end and the heel side of the sloped surface is shaped with acute angle.

16. The golf club head according to claim 9,
wherein the transfer sheet comprises an adhesive layer, a printed layer, and a protective layer, and the adhesive layer is adhered to the sloped surface.

* * * * *